US011084068B2

(12) United States Patent
Soellner et al.

(10) Patent No.: US 11,084,068 B2
(45) Date of Patent: Aug. 10, 2021

(54) DEVICE AND METHOD WHICH RECOVERS HEAT FROM LIQUIDS DURING CLEANING OF A PLANT PART THAT IS TO BE CLEANED OF A BEVERAGE FILLING PLANT

(71) Applicant: KRONES AG, Neutraubling (DE)

(72) Inventors: Juergen Soellner, Neutraubling (DE); Holger Mueller, Neutraubling (DE)

(73) Assignee: KRONES AG, Neutraubling (DE)

( * ) Notice: Subject to any disclaimer, the term of this patent is extended or adjusted under 35 U.S.C. 154(b) by 239 days.

(21) Appl. No.: 15/579,908

(22) PCT Filed: Nov. 10, 2016

(86) PCT No.: PCT/EP2016/077270

§ 371 (c)(1),
(2) Date: Mar. 5, 2018

(87) PCT Pub. No.: WO2017/081155

PCT Pub. Date: May 18, 2017

(65) Prior Publication Data

US 2018/0178258 A1 Jun. 28, 2018

(30) Foreign Application Priority Data

Nov. 10, 2015 (DE) ..... 10 2015 119 318.3

(51) Int. Cl.
*B08B 3/08* (2006.01)
*B08B 3/14* (2006.01)
(Continued)

(52) U.S. Cl.
CPC ..... *B08B 3/14* (2013.01); *B08B 3/08* (2013.01); *B08B 3/10* (2013.01); *B08B 9/032* (2013.01);
(Continued)

(58) Field of Classification Search
CPC ..... A47L 15/4291; A01J 7/022; A01J 7/027; B08B 3/08; B08B 3/10; B08B 3/14;
(Continued)

(56) References Cited

U.S. PATENT DOCUMENTS 4,156,621 A * 5/1979 Andrews ..... A47L 15/4291 134/10
2010/0229899 A1* 9/2010 Andersen ..... B08B 3/00 134/34

FOREIGN PATENT DOCUMENTS

CN 204404866 6/2015
DE 102013000522 7/2014
(Continued)

OTHER PUBLICATIONS

Machine Translation of DE 102013000522 A1, Fickert, Jul. 2014. (Year: 2014).*
(Continued)

*Primary Examiner* — David G Cormier
(74) *Attorney, Agent, or Firm* — Haynes and Boone, LLP

(57) ABSTRACT

A device for cleaning a plant part that is to be cleaned in a beverage filling plant, including a medium inflow for supplying a cleaning medium to the plant part that is to be cleaned, and having a medium return flow for removing the used cleaning medium from the plant part that is to be cleaned is described. A heating unit is provided for heating the cleaning medium in the medium inflow, and a recuperator is provided for transferring heat energy from the cleaning medium that is removed via the medium return flow to the cleaning medium that is to be supplied to the heating unit.

17 Claims, 1 Drawing Sheet

(51) Int. Cl.

| | |
|---|---|
| ***B67C 3/00*** | (2006.01) |
| ***B08B 9/032*** | (2006.01) |
| ***B08B 3/10*** | (2006.01) |

(52) U.S. Cl.
CPC ..... *B67C 3/001* (2013.01); *B08B 2203/007* (2013.01); *B08B 2209/032* (2013.01)

(58) Field of Classification Search
CPC ..... B08B 9/027; B08B 9/032; B08B 9/0321; B08B 9/08; B08B 9/0804; B08B 9/0813; B08B 9/093; B08B 9/0933; B08B 9/0936; B08B 2203/007; B08B 2209/032; B67C 3/001
See application file for complete search history.

(56) References Cited

FOREIGN PATENT DOCUMENTS

| | | |
|---|---|---|
| JP | S61-113455 | 5/1986 |
| JP | H06-246248 | 9/1994 |
| JP | 2009189905 | 8/2009 |
| WO | WO 2013/128200 | 9/2013 |

OTHER PUBLICATIONS

Office Action, Japan Patent Application No. 2017-563010, dated Sep. 1, 2020, 5 pages.

* cited by examiner

DEVICE AND METHOD WHICH RECOVERS HEAT FROM LIQUIDS DURING CLEANING OF A PLANT PART THAT IS TO BE CLEANED OF A BEVERAGE FILLING PLANT

CROSS REFERENCE TO RELATED APPLICATIONS

This application is a national stage of International Application No. PCT/EP2016/077270, filed Nov. 10, 2016, which claims priority from German Patent Application No. 10 2015 119 318.3 filed on Nov. 10, 2015 in the German Patent and Trademark Office, the disclosures of which are incorporated herein by reference in their entirety.

BACKGROUND

Technical Field

The present invention relates to a device for cleaning a plant part that is to be cleaned in a beverage filling plant, for example a filler area and/or a capper area that is to be cleaned in a beverage filling plant.

Related Art

In beverage filling plants, it is known to clean regularly parts of the plant that need to be cleaned, for example the filler, the capper and/or the transport devices disposed between them. Differing cleaning devices and cleaning methods are known for cleaning the parts of the plant or the entire filling plant, with a general distinction being made between exterior cleaning and interior cleaning of the parts of the plant.

In an exterior cleaning, the surfaces on the exterior of the plant parts that are to be cleaned are cleaned by means of the application of cleaning media via spray nozzles or flood nozzles. This exterior cleaning usually also includes the rinsing of the inner walls of an enclosure of the beverage filling plant, using the applicable cleaning media.

In an interior cleaning, all paths that come into contact with the product are cleaned, hence in particular the filling product lines and other medium lines in the beverage filling plant. For this purpose, the cleaning medium is caused to flow through the parts of the plant that are to be cleaned, in particular each of the filling product paths, thus achieving their cleaning. In the closed systems of the beverage filling plant, for example the valve clusters, the medium inflow and the other medium lines, a cleaning-in-place (CIP cleaning) is usually carried out. This can be performed in the interior of the production plant without the disassembly of components of the plant.

The interior cleaning and the exterior cleaning can be performed simultaneously or successively. A sequence of different cleaning media is usually used in order to achieve the desired cleaning effect.

The term "cleaning media" is here to be understood as referring to all media that are used during the cleaning process. The cleaning media are, for example, used in the following steps during the cleaning process: pre-rinsing with clear water, cleaning with lye, intermediate rinsing with clear water, cleaning with acid, clear rinsing with hot water, and sterilization by means of superheated steam. At least the following are regarded as cleaning media: clear water, hot water, acid, lye and superheated steam.

The supply and preparation of the cleaning media that are used in each case also has great importance. In particular, it is essential for complete and hygienically sound cleaning of the components of the plant that each of the cleaning media is provided with the specified concentration of cleaning agent and at the specified temperature.

Differing methods are known for supplying and/or preparing each of the cleaning media. In particular there is a contrast between "lost" cleaning and recirculating cleaning. In lost cleaning, the applicable cleaning medium is introduced into the part of the plant that is to be cleaned, and then discarded and discharged from the outlet of the applicable part of the plant, either directly or after recirculation during a single cleaning phase. Thus in the case of lost cleaning the cleaning media are freshly supplied and newly prepared for each cleaning phase.

In recirculating cleaning, the applicable cleaning media, for example fresh water, acid or lye, are stored temporarily in holding tanks between the individual cleaning cycles, then used for the applicable cleaning phase, then discharged from the outlet of the plant component and conveyed back to the applicable holding tank. Before a new cleaning phase, or during the same cleaning phase, the applicable cleaning medium is treated, for example by dosing with fresh water and cleaning concentrate and/or by filtering.

Combined methods are also known, in which a portion of the cleaning media is temporarily stored, while other cleaning media are discarded after a single use or, following recirculation, discarded when the applicable cleaning cycle is completed.

During the cleaning, it is important that, after completion of the cleaning with lye and/or acid of the plant parts that are to be cleaned, each part of the plant that has been treated is post-rinsed with fresh water such that it is completely free of chemicals. This is in order to prevent any constituents of the cleaning chemicals from entering the filling product during the subsequent filling operation. It can further be advantageous for the areas of the plant to dry quickly, in order either to enable a subsequent sterilization stage, for example in the case of aseptic plants, or else at least to enable production to restart quickly. For this purpose it is desirable for the rinsing water, and in particular the water for the post-rinse, to be as hot as possible when applied to the surfaces, in order to enable rapid evaporation of the water on the parts of the plant that have been heated in this manner. This also makes it possible, for example, to start a subsequent dry sterilization with evaporated hydrogen peroxide sooner.

It is known to provide a heat exchanger for heating the applicable cleaning medium, and in particular the rinse water for the intermediate rinsing or post-rinsing of the surfaces of the plant part that is to be cleaned, wherein the required quantity of heat is supplied to the heat exchanger by means of process steam or process hot water.

In order to heat cold process water in a heat exchanger by means of steam or hot water, and in order to provide a large quantity of water for rapid rinsing of the parts of the plant that are to be cleaned, large quantities of process steam or process hot water are needed within a short period. Accordingly, in the known systems there is a high demand for steam for the short periods of cleaning, and in particular of the hot post-rinsing. The rapid heating also subjects the heat exchanger to high material stresses. In addition, the regulation of the desired temperature must be very accurate, in order to avoid introducing cold water into the areas of the plant that have already been cleaned and prevent renewed microbiological contamination.

In the known systems, in order to avoid exceeding the performance limit of the available steam network due to the high demand for steam for the process step of post-rinsing, large-sized steam generators are usually provided.

SUMMARY

A device for cleaning a plant part that is to be cleaned in a beverage filling plant is proposed, including a medium inflow for supplying a cleaning medium to the plant part that is to be cleaned, and a medium return flow for removing the used cleaning medium from the plant part that is to be cleaned, wherein a heating unit is provided for heating the cleaning medium in the medium inflow. A recuperator is provided for transferring heat energy from the cleaning medium that is removed via the medium return flow to the cleaning medium that is to be supplied to the heating unit.

Due to the fact that, in addition to the heating unit for heating the cleaning medium in the medium inflow, a recuperator is provided, by means of which at least a portion of the heat energy that is still present in the used cleaning medium can be transferred to the cleaning medium in the medium inflow after the used cleaning medium has flowed through the plant part and been removed via the medium return flow from the plant part that is to be cleaned, the heat energy required for the heating unit can be reduced. This is particularly the case if, for example, in order to carry out a post-rinse or clear rinse of the plant parts that are to be cleaned following the application of chemicals, a lost cleaning rinse is performed, such that the used water is discarded after flowing only once through the plant part that is to be cleaned. In this case it is possible to transfer to the freshly supplied cleaning medium, by means of the recuperator, the heat energy that was introduced into the already used and eventually discarded cleaning medium. Accordingly, the heating performance required from the heating unit can be reduced, and the heating unit and/or the energy supply can have smaller overall dimensions.

The result is, firstly, an overall saving of heat energy, since a significant portion of the energy expended on heating is reused. Secondly, it is possible to reduce the maximum energy consumption for the heating of, for example, water for post-rinsing. If the energy is supplied by means of steam, it is also possible as a result for a steam generator in the beverage filling plant to have smaller dimensions.

At the same time, this also results in a higher level of hygiene safety, since it can be ensured in an efficient manner that the water used for post-rinsing at least achieves the specified target temperature, without, for example, a steam network of the beverage filling plant reaching the limit of its performance.

It can further be achieved that newly supplied cleaning medium is preheated by means of the recuperator, so that the material loading within the heating unit and within the recuperator is not as high, since the differences in temperature or temperature gradients that are to be handled are not as great, due to the two-stage heating process, namely first via the recuperator and then by means of the heating unit.

As a further advantage, it is to be recognized that, by means of the use of the recuperator, the discarded cleaning medium has a considerably reduced temperature, and accordingly the thermal load on the waste water network is reduced.

In addition, it is possible to dispense with the use of holding tanks for the provision of cleaning medium, so that a more compact design of the plant as a whole can be achieved. Due to the fact that the use of holding tanks for the applicable process water is avoided, it is also possible to avoid risks to hygiene which might be associated with the storage of cleaning media. Accordingly, the cleaning and sterilization process as a whole can be designed to be more microbiologically and hygienically stable.

The recuperator is typically disposed upstream of the heating unit in the medium inflow, in order to achieve the pre-heating of each of the cleaning media. The temperature level of the cleaning medium is thereby raised in a stepwise manner, in order in this manner to achieve efficient heating of the water used for the post-rinse, as well as reduced material loading of the heating unit and the recuperator.

In an advantageous embodiment, the heating unit is a heat exchanger, for example a heat exchanger operating with steam or hot water. The use of process steam or process hot water, which is in any case provided in the beverage filling plant, here permits efficient heating of the cleaning medium.

The medium return flow is in certain embodiments switchably connected with a drainage connection, and the drainage connection is provided downstream of the recuperator in the medium return flow. The drainage connection can be designed for example in the form of a gully. In this manner it can be achieved that, before it is discarded, the used cleaning medium, which is removed from the plant part to be cleaned via the medium return flow, transfers the quantity of heat that it carries, in full or at least to a significant extent, to the fresh cleaning medium that is contained in the medium inflow.

In a further development, the medium return flow is connected with the medium inflow via a buffer circulation which includes a buffer tank. In this manner a cleaning medium can be circulated and buffered temporarily during the cleaning of the part of the plant to be cleaned, until it is replaced by a subsequent cleaning medium. This enables efficient cleaning to be achieved.

A fresh water connection feeding into the medium inflow is generally disposed upstream of the recuperator. The fresh water can thus initially flow through the recuperator before it is used for cleaning the parts of the plant that are to be cleaned. Fresh water can accordingly flow first through the recuperator and then through the heating unit, in order thereby to enable the temperature of the fresh water to be raised in an efficient and stepwise manner.

A method for cleaning a plant part that is to be cleaned in a beverage filling plant is proposed, including the supplying of a cleaning medium to the plant part that is to be cleaned, and the removal of the used cleaning medium from the plant part that is to be cleaned, wherein, prior to the supplying of the cleaning medium to the plant part that is to be cleaned, the cleaning medium is heated by means of a heating unit. Prior to the heating of the cleaning medium by means of the heating unit, heat energy from the removed cleaning medium is transferred to the cleaning medium that is to be supplied to the heating unit.

BRIEF DESCRIPTION OF THE FIGURES

Further embodiments and aspects of the present invention are more fully explained by the description below of the figures.

DETAILED DESCRIPTION

Examples of embodiments are described below with the aid of the figures. In the figures, elements which are identical or similar, or have identical effects, are designated with identical reference signs, and in order to avoid redundancy repeated description of these elements is in part dispensed with.

Figure 1:
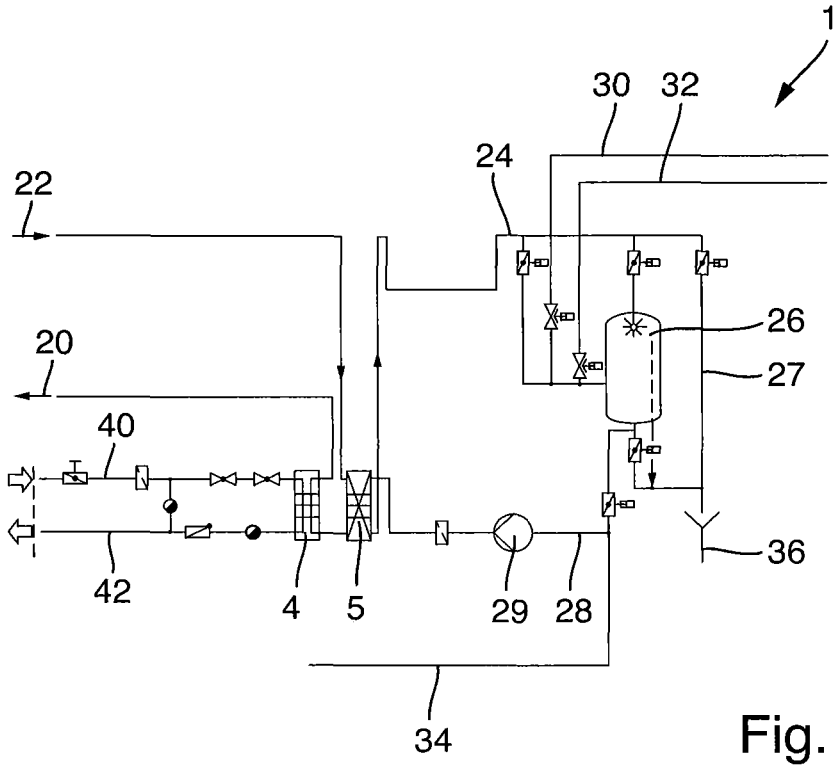
FIG. 1 is a schematic circuit representation of an example embodiment of the proposed device.

FIG. 1 shows schematically a device 1 for cleaning a plant part that is to be cleaned in a beverage filling plant. The cleaning of the parts of the plant takes place by means of cleaning media, which are conveyed to the part of the plant that is to be cleaned via a medium inflow 20, and away from the part of the plant that is to be cleaned via a medium return flow 22. The cleaning media can thereby be conveyed in a cycle.

In order to clean the exterior of the part of the plant that is to be cleaned, the medium inflow 20 discharges, for example, into exterior cleaning nozzles or flood nozzles, by means of which the cleaning medium that is supplied via the medium inflow 20 is applied to the surfaces that are to be cleaned of the part of the plant that is to be cleaned. The medium inflow 20 can, however, also be introduced into a closed area of the part of the plant that is to be cleaned, for example into the product lines and other medium lines, in order to perform an interior cleaning of the parts of the plant that are to be cleaned. In this case, the cleaning medium can in particular be used in a CIP cleaning. The supplying of cleaning media for either external cleaning or internal cleaning of plant parts in beverage filling plants is known in principle.

After it has completed flowing through the plant part that is to be cleaned, or completed flowing over the surfaces to be cleaned, the used cleaning medium is returned via the medium return flow 22.

In the case of exterior cleaning, the used cleaning medium reaches the medium return flow 22 for example by means of the collection of the cleaning medium flowing off of the surfaces at one or more runoff points of the plant part that is to be cleaned. For this, a floor plate or equipment table which provides suitable outflows is usually provided in the floor area of the plant part that is to be cleaned. The floor area can for example also be designed as a funnel-shaped floor, which collects all media that run off at a single outflow point and discharges these media into the medium return flow 22.

In the case of interior cleaning of the plant part that is to be cleaned, it can similarly be provided that the used cleaning medium is removed via the floor area of the plant part that is to be cleaned, for example if the cleaning medium, after flowing through the filling product path, flows out of the filling valves and is similarly collected in the floor area of the floor area of the plant part that is to be cleaned. In the case of interior cleaning also, the cleaning medium can have a closed cycle, in which the used cleaning medium is returned in a cycle via suitable cleaning channels, which are also referred to as CIP channels, and conveyed to the medium return flow 22.

The cleaning medium that is supplied via the medium inflow 20 and returned via the medium return flow 22 can be conveyed in a cycle in the device 1, wherein a circulation line 24 is provided to convey the cleaning medium from the medium return flow 22 to a buffer tank 26. From the buffer tank 26, the cleaning medium is again conveyed to the medium inflow 20, via a supply line 28 which also includes a pump 29.

In order to enable differing cleaning media to be provided, and the cleaning medium that is conveyed in a cycle to be regenerated, for example the supply of an acid concentrate is provided via an acid supply line 30 and the supply of a lye concentrate is provided via a lye supply line 32. Accordingly, in order to produce or maintain a desired concentration of lye or acid, the concentrate can be conveyed via the lye supply line 32 or the acid supply line 30 respectively to the cleaning medium that is accommodated in the buffer tank 26. In this case, the desired concentration can be monitored by sensors provided in the circulation line 24, which control the supply of acid or lye by means of a suitable feedback control.

Fresh water can be fed into the system via a fresh water connection 34. The fresh water connection 34 thereby enables fresh water to be supplied, in order either to achieve the replacement of a first cleaning medium with a second cleaning medium, or to compensate for the loss of cleaning medium due to the cleaning itself and the evaporation of cleaning medium.

The cleaning medium, which is accommodated in the buffer tank 26, or prepared or treated in the buffer tank 26, can be removed from the device 1 via a drainage connection 36.

The cleaning medium can be conveyed past the buffer tank 26 via a bypass 27. This is particularly advantageous if clear water is used as the cleaning medium, and for example it is used for a pre-rinse immediately after production, or is used for intermediate rinsing or post-rinsing. The water does not need to be stored in the interim in the buffer tank 26. In the case of the pre-rinse, in which a significant portion of filling product remains to be transported with the pre-rinse water, the cleaning medium can also be conveyed via the bypass 27 directly to the drainage connection 36, and discarded.

Accordingly, for example in order to carry out a preliminary cleaning, a cleaning medium in the form of fresh water can be introduced into the medium inflow 20 via the fresh water connection 34, the part of the plant that is to be cleaned can be cleaned with the fresh water, and the cleaning medium can then be conveyed via the medium return flow 22 and the bypass 27 directly to the drainage connection 36. No recirculation thereby takes place.

For a subsequent cleaning of the parts of the plant that need to be cleaned, either lye supplied via the lye supply line 32, or acid supplied via the acid supply line 30, is added to the fresh water supplied via the fresh water connection 34, in order thereby to provide the cleaning medium with the applicable acid or lye concentrates. The cleaning media can then be stored temporarily, by means of the buffer tank 26, for cleaning and in order to provide a suitable exposure time, and recirculated by means of the pump 29. During the cleaning phase, the chemical composition is constantly checked, and if necessary readjusted by the introduction of additional fresh water or by the adding of acid or lye concentrates.

In the cleaning of parts of the plant that are to be cleaned, the important factors are not only the composition of the chemicals and the mechanical application of cleaning impulses, but also a third factor, the temperature. Because of this, the cleaning medium is heated by means of a heating unit 4.

The heating unit 4 is provided in the medium inflow 20, such that the cleaning medium, which is supplied via the medium inflow 20 to the plant parts that are to be cleaned, is brought to the intended temperature by means of the heating unit 4. In the example embodiment that is shown, the heating unit 4 is provided in the form of a heat exchanger, which is supplied with process steam via a steam line 40. The condensate is returned via a condensate line 42. In the heating unit 4, which is provided as a steam heat exchanger, the cleaning medium that is supplied to the medium inflow 20 can be brought to the target temperature. For this purpose, a temperature sensor, by means of which the heat output of the heat exchanger can be regulated, can be provided downstream of the heating unit 4.

In addition, a recuperator 5 is provided in the medium inflow 20 upstream of the heating unit 4. The cleaning medium that is to be conveyed to the heating unit 4 flows through the recuperator 5. In other words, the recuperator 5 is disposed in the medium inflow 20, and cleaning medium that is to be conveyed to the part of the plant that is to be cleaned flows through it before entering the heating unit 4. The cleaning medium in the medium inflow 20 is conveyed into a first chamber system of the recuperator 5.

Cleaning medium that is returned via the medium return flow 22 flows through the second chamber system of the recuperator 5. By this means, at least a significant portion of the heat energy that is present in the cleaning medium that is returned via the medium return flow 22 can be transferred to the cleaning medium that flows through the medium inflow 20, before the cleaning medium flows through the heating unit 4. Thus by means of the recuperator 5 the cleaning medium can be pre-heated before it flows into the heating unit 4.

By this means it possible to reduce the required heat output of the heating unit 4 that is needed to reach the target temperature of the cleaning medium in the medium inflow 20. By the use of the recuperator 5, it is thereby also possible to reduce the maximum energy that needs to be transferred by means of the heating unit 4 to the cleaning medium in the medium inflow 20. It is thereby possible to reduce, for example, the load on the steam network of the beverage filling plant.

If a lost cleaning method is used, in which the cleaning medium is removed via the drainage connection 36, it is particularly advantageous that the heat energy that is still present in the discarded cleaning medium is transferred, to a substantial extent, to the new cleaning medium, before the new cleaning medium, which is now pre-heated, is heated to its target temperature in the heating unit 4.

The effect can be particularly well understood by means of the example of post-rinsing following the completion of chemical cleaning. In particular, fresh water for post-rinsing is introduced into the supply line 28 via the fresh water connection 34, then pumped via the pump 29 through the recuperator 5, and then heated to the target temperature by means of the heating unit 4. The cleaning medium that is still in the cleaning system from the previous cleaning step, for example, is at a higher temperature, with the result that the cleaning medium that is returned via the medium return flow 22 raises the fresh water in the recuperator 5 to a first temperature level. Accordingly, the heating performance of the heating unit 4 can be reduced.

In addition, when a further flow of fresh water is added via the fresh water connection 34, a significant part of the heat energy that is contained in the rinse water that is returned via the medium return flow 22 can be transferred to the fresh water.

Furthermore, the discarded cleaning medium which is guided into the drainage connection 36 has lost some of its heat after flowing through the recuperator 5, so that an excessive thermal load on the waste water network is avoided.

As a result, the overall heating performance of the heating unit 4 can be reduced, particularly when the parts of the plant that are to be cleaned are post-rinsed, in which case it is advantageous to post-rinse with very hot water in order to achieve rapid drying of the parts of the plant that have been rinsed. It is also possible by this means to reduce the quantity of steam which needs to be supplied via the steam line 40.

Figure 2:
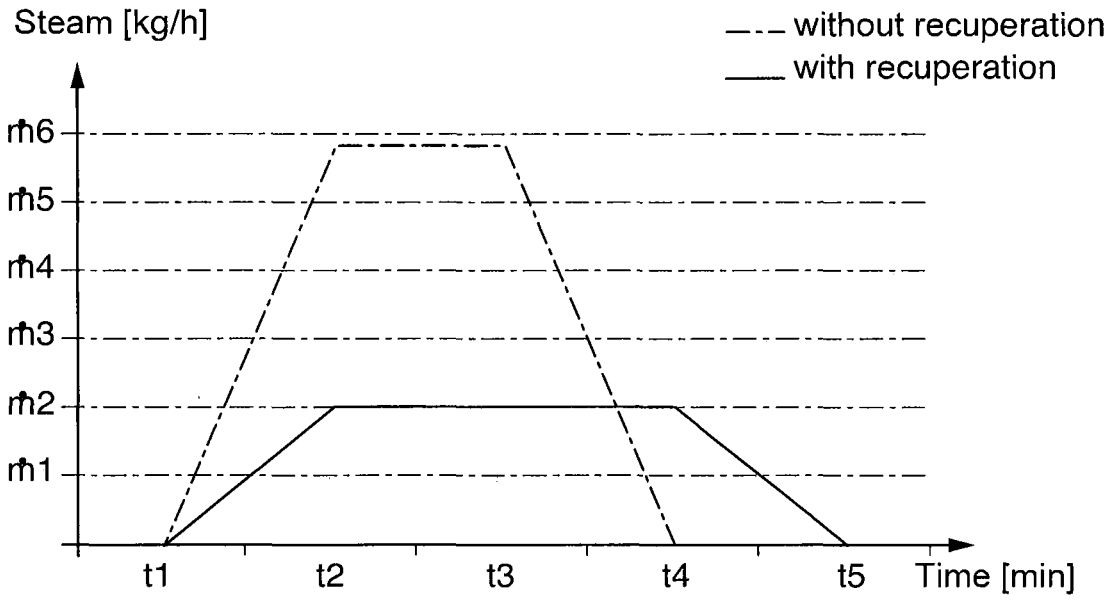
FIG. 2 is a schematic representation of the steam consumption of the heating unit over time.

In FIG. 2, a dash-dot curve shows schematically the consumption over time of steam for a heating unit according to the state of the art, which operates without the use of a recuperator.

By way of contrast, the solid line shows the consumption over time of steam for the heating unit 4 of the present design, with the use of the recuperator 5. It is immediately clear that the maximum consumption of steam from the steam network is significantly reduced, with the result that a peak load on the steam network can be reduced. In this manner it can be achieved that the dimensions of a steam generator for a steam network of the plant can be reduced, so that the beverage filling plant as a whole can thereby be designed more efficiently.

To the extent applicable, all individual features described in the example embodiments can be combined with each other and/or exchanged, without departing from the field of the invention.

The invention claimed is:

1. A system comprising:
a beverage filling plant; and
a device configured to clean a plant part in the beverage filling plant, comprising:
a medium inflow configured to supply a cleaning medium to the plant part;
a medium return flow configured to remove at least a portion of the cleaning medium from the plant part;
a buffer tank that connects the medium return flow with the medium inflow;
a heating unit configured to heat the cleaning medium in the medium inflow, wherein the heating unit comprises a heat exchanger operating with process steam or process hot water provided by the beverage filling plant; and
a recuperator configured to transfer heat energy from the cleaning medium that is removed via the medium return flow to the cleaning medium that is to be supplied to the heating unit.

2. The system of claim 1, wherein the recuperator is disposed upstream of the heating unit.

3. The system of claim 1, wherein the device further comprises a drainage connection that is switchably connected with the medium return flow.

4. The system of claim 3, wherein the drainage connection is disposed downstream of the recuperator.

5. The system of claim 1, wherein the device further comprises a circulation line that conveys the cleaning medium from the medium return flow to the buffer tank.

6. The system of claim 1, wherein the device further comprises a bypass configured to transport the cleaning medium past the buffer tank.

7. The system of claim 1, wherein the device further comprises a pump configured to push the cleaning medium to the medium inflow from the buffer tank.

8. The system of claim 1, wherein the device further comprises an acid supply line and a lye supply line.

9. The system of claim 1, wherein the device further comprises a fresh water connection feeding into the medium inflow and disposed upstream of the recuperator.

10. The system of claim 1, wherein the heating unit comprises a heat exchanger operating with the process steam provided by the beverage filling plant via a steam line.

11. A method for cleaning the plant part in the system of claim 1, comprising:

supplying, by the medium inflow, the cleaning medium to the plant part;

removing, by the medium return flow, the at least a portion of the cleaning medium from the plant part;

heating, by the heating unit, the cleaning medium prior to supplying the cleaning medium to the plant part; and transferring heat energy, by the recuperator, from the cleaning medium that is removed by the medium return flow to the cleaning medium that is to be supplied to the heating unit prior to heating the cleaning medium that is to be supplied to the heating unit.

12. The method of claim 11, further comprising:

introducing water into a supply line;

pumping the water in the supply line through the recuperator; and heating the pumped water to a target temperature by the heating unit.

13. The method of claim 11, further comprising conveying the cleaning medium to the buffer tank.

14. The method of claim 13, further comprising removing the cleaning medium in the buffer tank via a drainage connection.

15. The method of claim 11, further comprising introducing water to the plant part and conveying used water directly to a drainage connection.

16. The method of claim 11, further comprising checking a chemical composition of the cleaning medium.

17. The method of claim 16, further comprising adjusting the chemical composition by adding fresh water, acid concentrate, and/or lye concentrate.

* * * * *